US010954884B2

(12) United States Patent
Hopf et al.

(10) Patent No.: US 10,954,884 B2
(45) Date of Patent: Mar. 23, 2021

(54) INTERNAL COMBUSTION ENGINE WITH CYLINDER HEAD, AND METHOD FOR PRODUCING A CYLINDER HEAD OF AN INTERNAL COMBUSTION ENGINE OF SAID TYPE

(71) Applicant: Ford Global Technologies, LLC, Dearborn, MI (US)

(72) Inventors: Anselm Hopf, Baesweiler (DE); Guenter Bartsch, Gummersbach (DE); Frank Kraemer, Neunkirchen-Seelscheid (DE); Florian Huth, Aachen (DE); Jens Dunstheimer, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 27 days.

(21) Appl. No.: 16/292,957

(22) Filed: Mar. 5, 2019

(65) Prior Publication Data

US 2019/0277222 A1 Sep. 12, 2019

(30) Foreign Application Priority Data

Mar. 6, 2018 (DE) ..... 102018203291.2

(51) Int. Cl.
*F02F 1/42* (2006.01)
*F01N 13/10* (2010.01)
(Continued)

(52) U.S. Cl.
CPC ..... *F02F 1/4264* (2013.01); *F01N 13/10* (2013.01); *F02F 1/42* (2013.01); *F02F 1/4214* (2013.01);
(Continued)

(58) Field of Classification Search
CPC ... F01N 13/10; F02B 75/20; F02F 1/42; F02F 1/4214; F02F 1/4264; F02F 2001/4278
See application file for complete search history.

(56) References Cited

U.S. PATENT DOCUMENTS 4,537,028 A 8/1985 Humke
8,857,164 B2 10/2014 Okami
(Continued)

FOREIGN PATENT DOCUMENTS

CN 201292876 Y 8/2009
CN 106150640 A 11/2016
(Continued)

OTHER PUBLICATIONS

Kirby, G., "Just the Way You're Crimped—Exhaust R&D, Part 2: Testing the Crimp Myth," Mishimoto Automotive Website, Available Online at https://www.mishimoto.com/engineering/2016/05/just-the-way-youre-crimped-2016-camaro-exhaust-rd-part-2-testing-the-crimp-myth/, May 2, 2016, 7 pages.

*Primary Examiner* — Audrey K Bradley
(74) *Attorney, Agent, or Firm* — Geoffrey Brumbaugh; McCoy Russell LLP

(57) ABSTRACT

The application relates to internal combustion engines, cylinder heads, exhaust passages, and shapes and configurations of the exhaust passages. The exhaust passage may have cross-sectional shapes formed by two limbs. The cross-sectional shape of the exhaust passage may change as the passage extends. The exhaust passage may also merge with other exhaust passage. The exhaust passage may be part of a cylinder head or an exhaust manifold.

13 Claims, 7 Drawing Sheets

(51) Int. Cl.

| | |
|---|---|
| ***F02B 75/20*** | (2006.01) |
| *B22D 25/02* | (2006.01) |
| *F02B 75/18* | (2006.01) |

(52) U.S. Cl.

CPC ..... *B22D 25/02* (2013.01); *F02B 75/20* (2013.01); *F02B 2075/1812* (2013.01); *F02F 2001/4278* (2013.01); *F02F 2200/06* (2013.01)

(56) References Cited

U.S. PATENT DOCUMENTS

| | | | | |
|---|---|---|---|---|
| 2005/0115231 | A1* | 6/2005 | Ashida | F01N 13/10 60/313 |
| 2011/0132296 | A1 | 6/2011 | Kuhlbach | |
| 2015/0167583 | A1* | 6/2015 | Sakamoto | F01P 1/02 60/323 |
| 2016/0003117 | A1* | 1/2016 | Cook | F02B 19/12 60/321 |
| 2017/0321622 | A1* | 11/2017 | Hayman | F02F 11/002 |
| 2018/0187625 | A1* | 7/2018 | Hopf | F02F 1/243 |

FOREIGN PATENT DOCUMENTS

| | | | |
|---|---|---|---|
| DE | 102012020381 | A1 | 4/2014 |
| FR | 2929653 | A1 | 10/2009 |
| JP | 2005048713 | A | 2/2005 |
| JP | 2011247270 | A | 12/2011 |

* cited by examiner

INTERNAL COMBUSTION ENGINE WITH CYLINDER HEAD, AND METHOD FOR PRODUCING A CYLINDER HEAD OF AN INTERNAL COMBUSTION ENGINE OF SAID TYPE

CROSS REFERENCE TO RELATED APPLICATION

This application claims priority to German Patent Application No. 102018203291.2, filed Mar. 6, 2018. The entire contents of the above-referenced application are hereby incorporated by reference in their entirety for all purposes.

FIELD

This application relates to internal combustion engines, exhaust passages, and shapes and configurations of the exhaust passages.

BACKGROUND

An internal combustion engine may be used for example as a motor vehicle drive unit. Within the context of the present application, the expression "internal combustion engine" encompasses diesel engines and petrol engines, but also hybrid internal combustion engines which are operated with a hybrid combustion process, and hybrid drives. Hybrid drives include an internal combustion engine and at least one further torque source for driving a motor vehicle. For example, an electric machine which can be or is connected to the internal combustion engine and which outputs power instead of the internal combustion engine or in addition to the internal combustion engine. Under certain circumstances, the further torque source receives power from the internal combustion engine.

Internal combustion engines have at least one cylinder head which, in order to form the at least one cylinder, that is to say the at least one combustion chamber, is connected to a cylinder block. Bores for receiving connecting elements are provided in the cylinder head and in the cylinder block.

To accommodate the pistons or the cylinder liners, the cylinder block has a corresponding number of cylinder bores, in which the pistons are guided in axially movable fashion. The cylinder head conventionally serves to hold the valve drives. To control the charge exchange, an internal combustion engine requires control elements and actuating devices for actuating the control elements. During the charge exchange, the combustion gases are discharged via the at least one outlet opening and the charging of the combustion chamber takes place via the at least one inlet opening of the cylinder. To control the charge exchange, in four-stroke engines, use is made almost exclusively of lifting valves as control elements, which lifting valves perform an oscillating lifting movement during the operation of the internal combustion engine and which lifting valves open and close the inlet opening and outlet opening in this way. The valve actuating mechanism required for the movement of a valve, including the valve itself, is referred to as the valve drive. Here, a valve actuating device generally comprises a camshaft, wherein overhead camshafts, i.e. camshafts which are situated above the parting plane between cylinder head and cylinder block, are mounted on the cylinder head.

It is the object of a valve drive to open and close the at least one inlet opening and the at least one outlet opening of a cylinder at the correct times, wherein a fast opening of the largest possible flow cross-sections is sought in order to keep the throttling losses in the inflowing and outflowing gas flows low and in order to ensure the best possible charging of the cylinder and an effective, that is to say complete discharge of the combustion gases.

During the discharge of the exhaust gases into the exhaust-gas discharge system, a backflow of exhaust gas into the cylinders should be avoided or prevented. The evacuation of the combustion gases out of a cylinder of the internal combustion engine during the charge exchange is based substantially on two different mechanisms. When the outlet valve opens close to bottom dead center at the start of the charge exchange, the combustion gases flow at high speed through the outlet opening into the exhaust-gas discharge system on account of the high pressure level prevailing in the cylinder toward the end of the combustion and the associated high pressure difference between combustion chamber and exhaust line. This pressure-driven flow process is assisted by a high pressure peak which is also referred to as a pre-outlet shock and which propagates along the exhaust line at the speed of sound. The pressure of the pre-outlet shock is dissipated, that is to say reduced, to a greater or lesser extent with increasing distance travelled as a result of friction.

During the further course of the charge exchange, the pressures in the cylinder and in the exhaust line are equalized, such that the combustion gases are no longer evacuated primarily in a pressure-driven manner but rather are expelled as a result of the stroke movement of the piston.

As already mentioned, the pressure losses along the exhaust line, that is to say in the flow direction, increase with increasing distance travelled as a result of friction. It is basically sought to minimize said pressure losses. This is the case firstly in order to ensure an effective discharge of the exhaust gas without backflows. Secondly, minimizing loss provides exhaust gas which is as rich in energy as possible to a turbine which may be provided downstream in the exhaust-gas discharge system.

In the case of internal combustion engines supercharged by means of exhaust-gas turbocharging, it is therefore also sought to arrange the turbine as close as possible to the outlet of the internal combustion engine. A close arrangement optimally utilizes the exhaust-gas enthalpy of the hot exhaust gases, which is determined significantly by the exhaust-gas pressure and the exhaust-gas temperature, and to ensure a fast response behavior of the turbocharger.

Secondly, the path of the hot exhaust gases to the different exhaust-gas aftertreatment systems should also be as short as possible such that the exhaust gases are given little time to cool down and the exhaust-gas aftertreatment systems reach their operating temperature or light-off temperature as quickly as possible, in particular after a cold start of the internal combustion engine.

Integrated exhaust manifolds achieve the above-stated aims by merging the exhaust lines of an internal combustion engine within the cylinder head, that is to say the exhaust manifold is integrated entirely in the cylinder head. A cylinder head of said type is also characterized by a very compact design, which permits dense packaging of the drive unit as a whole. Furthermore, said exhaust manifold can benefit from a liquid-type cooling arrangement that may be provided in the cylinder head, such that the manifold does not need to be manufactured from thermally highly loadable and thus expensive materials.

The use of a cylinder head with integrated manifold also leads to a reduced number of components, and consequently to a reduction in costs, such as assembly and procurement costs, and to a reduction in weight of the cylinder head or internal combustion engine.

In an integrated manifold, the exhaust lines generally have a high degree of curvature to merge within the cylinder head. The exhaust gas flows, in particular from the outer cylinders, are generally deflected greatly which generates pressure losses. The torque characteristic or the efficiency of the internal combustion engine may thereby deteriorate. A greater knocking tendency and higher emissions may be further disadvantages.

The cylinder head of a modern internal combustion engine is generally thermally highly loaded and therefore also places increased demands on the cooling arrangement. The load is particularly high if the cylinder head is equipped with an integrated exhaust manifold and/or the internal combustion engine is a supercharged internal combustion engine.

If the internal combustion engine has a liquid cooling arrangement, a plurality of coolant ducts or at least one coolant jacket is generally formed in the cylinder head, the coolant ducts or coolant jacket conduct the coolant through the cylinder head. Embodiments of cylinder heads including integrated exhaust passages and cooling ducts creates a relatively complex cylinder head structure.

It will be appreciated that the cylinder head of an internal combustion engine is a thermally and mechanically highly loaded component. In applied-ignition internal combustion engines, the required ignition device may also be arranged in the cylinder head, and furthermore in the case of direct-injection internal combustion engines, the injection device may be arranged in the cylinder head.

Against the background of that stated above, it is an object of the present application to provide an internal combustion engine in which the exhaust gas discharge system is optimized with regard to the discharge of the exhaust gas.

One embodiment of an internal combustion engine includes at least one cylinder head comprising at least one cylinder, in which each cylinder has at least one inlet opening, each inlet opening being adjoined by an intake line for the supply of air via an intake system, each cylinder has at least one outlet opening, each outlet opening being adjoined by an exhaust line for the discharge of exhaust gas via an exhaust-gas discharge system, and at least one exhaust line has a cross-section which changes in a flow direction, wherein the cross-section has an L-shaped outline.

In one embodiment of the application, the cross-section of at least one exhaust line has a substantially L-shaped outline at least at points. In a flow direction, that is to say along the exhaust line and along the central flow filament, at least one exhaust line of the exhaust-gas discharge system changes its cross-section such that the cross-section is substantially L-shaped in outline at least at one point.

An L-shape may refer to two legs that are joined at a central point. The legs may have a substantially planar shape. The planar shaped legs may form an angle of approximately 90 degrees. Approximately may be construed as ten percent higher or lower than a stated value. For example, if an angle is approximately 90 degrees, it may be between 81 and 99 degrees. The delimiting edges of the legs may also include irregular shapes such as undulating edges. The edges of the legs may also include concave or convex curvature.

Embodiments of the application featuring an L-shaped cross-section have shown advantages when used in exhaust gas systems. The advantages are particularly strong when the cross-section is used an exhaust line of an outer cylinder, for example a cross-section of an exhaust line of the first or fourth cylinder of a four-cylinder in-line engine.

It has been found that an L-shaped cross-section may minimize or reduce the pressure losses as a result of friction. Firstly, an effective discharge of the exhaust gas can be realized without backflows. Secondly, a turbine, which may be provided downstream in the exhaust gas discharge system, of an exhaust-gas turbocharger can be provided with exhaust gas which is as rich in energy as possible.

Embodiments of the internal combustion engine are advantageous in which the cross-section has at least one rounded corner. It has proven to be advantageous from a flow aspect if the edge which delimits the cross-section has curvature or no sharp-edged corners. For example, a cross-section which an edge which delimits the cross-section runs in curving fashion and has no corners without substantial curvature.

Embodiments of the internal combustion engine may be advantageous in which an edge which delimits the cross-section runs in undulating fashion at least in sections, wherein both a regular and an irregular undulating profile may be expedient.

Embodiments of the internal combustion engine are advantageous in which the cross-section has two limbs which are connected together and form an angle $\alpha$. In this context, embodiments of the internal combustion engine may be advantageous in which the angle $\alpha$ meets the following criterion: $\alpha \geq 90°$. In this context, embodiments of the internal combustion engine may also be advantageous in which the angle $\alpha$ meets the following criterion: $\alpha \leq 90°$.

Embodiments of the internal combustion engine are advantageous in which the cross-section is arranged within the at least one cylinder head. The exhaust lines of the cylinder may merge within the cylinder head, so as to form an integrated exhaust manifold, or else outside the cylinder head, so as to form an external exhaust manifold.

If the exhaust lines merge within the cylinder head, so as to form an integrated exhaust manifold, the cross-section according to the application is arranged within the at least one cylinder head.

In internal combustion engines with at least two exhaust lines, embodiments may also be advantageous in which the at least two exhaust lines merge to form an overall exhaust line inside the at least one cylinder head, so as to form an integrated exhaust manifold.

In internal combustion engines with at least two cylinders, in which each cylinder has at least two outlet openings and each outlet opening is adjoined by an exhaust line for discharging exhaust gas via the exhaust-gas discharge system, embodiments may be advantageous in which the at least two exhaust lines of each cylinder first merge into a partial exhaust line before the partial exhaust lines merge into an overall exhaust line, forming an exhaust manifold. The merging of the exhaust lines in stages reduces the overall travel distance of all exhaust lines.

In internal combustion engines in which the exhaust lines merge into an overall exhaust line, forming an exhaust manifold, and in which the cross-section has two limbs which are connected together and form an angle $\alpha$, embodiments may be advantageous which are characterized in that a first upper limb of the cross-section of at least one exhaust line is arranged on the side of the exhaust manifold which faces away from the at least one cylinder, i.e. on the top side of the manifold.

In this context, embodiments of the internal combustion engine are advantageous in which a second side limb of the cross-section is arranged on the side of the exhaust manifold which faces an end of the at least one cylinder head, and hence faces outward. In other words, the second side limb does not face towards the inside of the manifold, wherein the inside of the manifold is itself delimited and framed by the exhaust lines of the manifold.

Embodiments of the internal combustion engine are here advantageous in which the second side limb tapers towards its free end.

In this context with the second side limb, embodiments are also advantageous in which the second side limb is designed to be narrower and/or shorter than the first upper limb.

Embodiments of the internal combustion engine may also be advantageous in which the cross-section is arranged outside the at least one cylinder head.

In internal combustion engines with at least two exhaust lines, embodiments may also be advantageous in which the at least two exhaust lines merge to form an overall exhaust line outside the at least one cylinder head, so as to form an external exhaust manifold, wherein the cross-section may be arranged inside or outside the at least one cylinder head.

Embodiments of the internal combustion engine are advantageous in which each cylinder is equipped with an injection device for the direct injection of fuel into the cylinder.

Direct injection is a concept for dethrottling an Otto-cycle engine, that is to say an applied-ignition internal combustion engine, in which the load control is realized by means of quantity regulation. The injection of fuel directly into the combustion chamber of the cylinder is to be considered to be a suitable measure for noticeably reducing fuel consumption even in Otto-cycle engines. The dethrottling of the internal combustion engine is realized by virtue of quality regulation being used within certain limits. With the direct injection of the fuel into the combustion chamber, it is possible to realize a stratified combustion chamber charge, which can contribute significantly to the dethrottling of the Otto-cycle engine working process. The stratified charge allows the internal combustion engine to be leaned with a great extent, which offers thermodynamic advantages, in particular in the low and medium load range when only small amounts of fuel are to be injected. Therefore, in this context, embodiments of the internal combustion engine are advantageous in which the injection device is arranged in each case in the cylinder head.

Embodiments of the internal combustion engine are advantageous in which a charging arrangement is provided. Embodiments of the internal combustion engine are advantageous in which at least one exhaust-gas turbocharger is provided which comprises a turbine arranged in the exhaust-gas discharge system and a compressor arranged in the intake system.

Supercharging is a suitable means for increasing the power of an internal combustion engine while maintaining an unchanged swept volume, or for reducing the swept volume while maintaining the same power. In all cases, supercharging leads to an increase in volumetric power output and a more expedient power-to-weight ratio. If the swept volume is reduced, it is possible, given the same vehicle boundary conditions, to shift the load collective toward higher loads, at which the specific fuel consumption is lower. Supercharging of an internal combustion engine consequently assists in the efforts to minimize fuel consumption and improve the efficiency.

By means of a suitable transmission configuration, it is additionally possible to realize so-called downspeeding, whereby a lower specific fuel consumption is likewise achieved. In the case of downspeeding, use is made of the fact that the specific fuel consumption at low engine speeds is generally lower, in particular in the presence of relatively high loads.

With targeted configuration of the supercharging, it is also possible to obtain advantages with regard to the exhaust-gas emissions. With suitable supercharging, for example of a diesel engine, the nitrogen oxide emissions can therefore be reduced without any losses in efficiency. At the same time, the hydrocarbon emissions can be positively influenced. The emissions of carbon dioxide, which correlate directly with fuel consumption, likewise decrease with falling fuel consumption.

For supercharging, an exhaust-gas turbocharger may be used, in which a compressor and a turbine are arranged on the same shaft. The hot exhaust-gas flow is fed to the turbine and expands in the turbine with a release of energy, as a result of which the shaft is set in rotation. The energy released by the exhaust-gas flow to the turbine and ultimately to the shaft is used for driving the compressor, which is likewise arranged on the shaft. The compressor conveys and compresses the charge air fed to it, as a result of which supercharging of the cylinders is obtained. A charge-air cooler is advantageously provided in the intake system downstream of the compressor, by means of which charge-air cooler the compressed charge air is cooled before it enters the cylinders. The cooler lowers the temperature and thereby increases the density of the charge air, such that the cooler also contributes to improved charging of the cylinders, that is to say to a greater air mass. Compression by cooling takes place.

The advantage of an exhaust-gas turbocharger in relation to a supercharger, which is driven by means of an auxiliary drive, consists in that an exhaust-gas turbocharger utilizes the exhaust-gas energy of the hot exhaust gases. Whereas, a supercharger draws the energy required for driving it directly or indirectly from the internal combustion engine and thus adversely affects, that is to say reduces, the efficiency, at least for as long as the drive energy does not originate from an energy recovery source.

If the supercharger is not one that can be driven by means of an electric machine, that is to say electrically, a mechanical or kinematic connection for power transmission is generally required between the supercharger and the internal combustion engine, which also adversely affects or determines the packaging in the engine bay.

The advantage of a supercharger in relation to an exhaust-gas turbocharger in turn consists in that the supercharger can generate, and make available, the required charge pressure at all times, specifically regardless of the operating state of the internal combustion engine. This applies in particular to a supercharger which can be driven electrically by means of an electric machine, and is therefore independent of the rotational speed of the crankshaft. Embodiments of the internal combustion engine may therefore also be advantageous in which at least one supercharger which can be driven by means of an auxiliary drive is provided.

Embodiments of the internal combustion engine are advantageous in which each cylinder is equipped with an ignition device to initiate external ignition, wherein the one respective ignition device is arranged in the cylinder head.

Embodiments of the internal combustion engine are advantageous in which the cross-section is inclined by an angle $\beta$ with respect to a longitudinal axis of the at least one cylinder. A value of $\beta$ may be as follows: $\beta \approx 45° \pm 20°$, in particular $\beta \approx 45° \pm 10°$.

The second sub-object, specifically that of specifying a method for producing a cylinder head of an internal combustion engine of an above-described type, is achieved by means of a method in which the cylinder head is cast.

That which has already been stated with regard to the internal combustion engine according to the application also applies to the method according to the application, for which reason reference is generally made at this juncture to the statements made with regard to the internal combustion engine.

Methods are also advantageous in which the cylinder head is produced by means of an additive manufacturing process, in which the cylinder head is built up in layers. Here, embodiments of the method are advantageous in which the cylinder head is produced by 3D printing.

BRIEF DESCRIPTION OF DRAWINGS

The application will be described in more detail below on the basis of exemplary embodiments in accordance with the figures listed below.

FIGS. 1A, 1B, 2A, 2B, 2C, 3, 4, and 6 are shown approximately to scale.

DETAILED DESCRIPTION

Figure 1A:
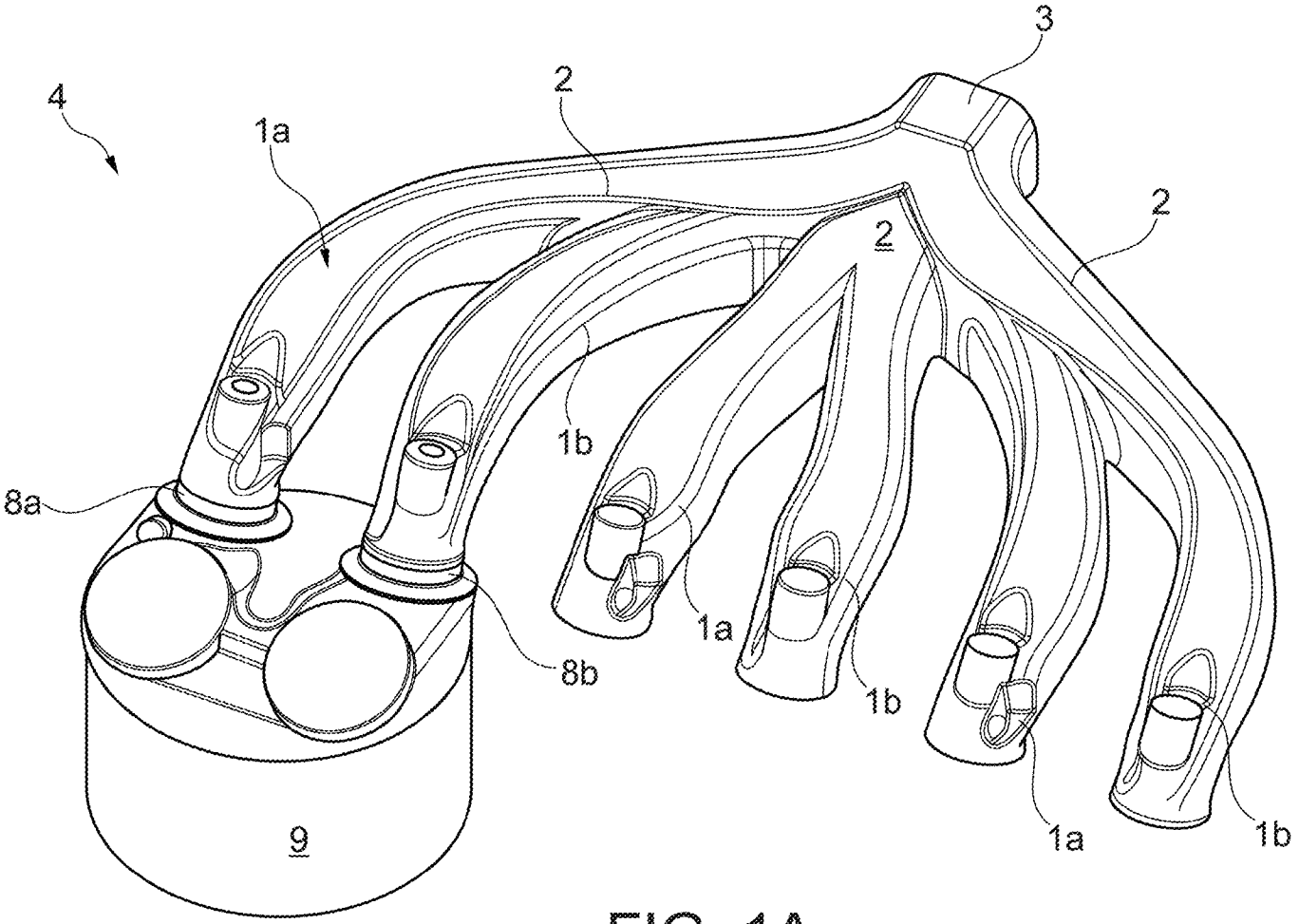
FIG. 1A shows diagrammatically, in a perspective view, a state-of-the-art exhaust manifold.

FIG. 1A shows diagrammatically, in a perspective view, a state-of-the-art exhaust manifold 4 integrated into the cylinder head of an embodiment of the internal combustion engine, together with a fragment of a cylinder 9.

Figure 1B:
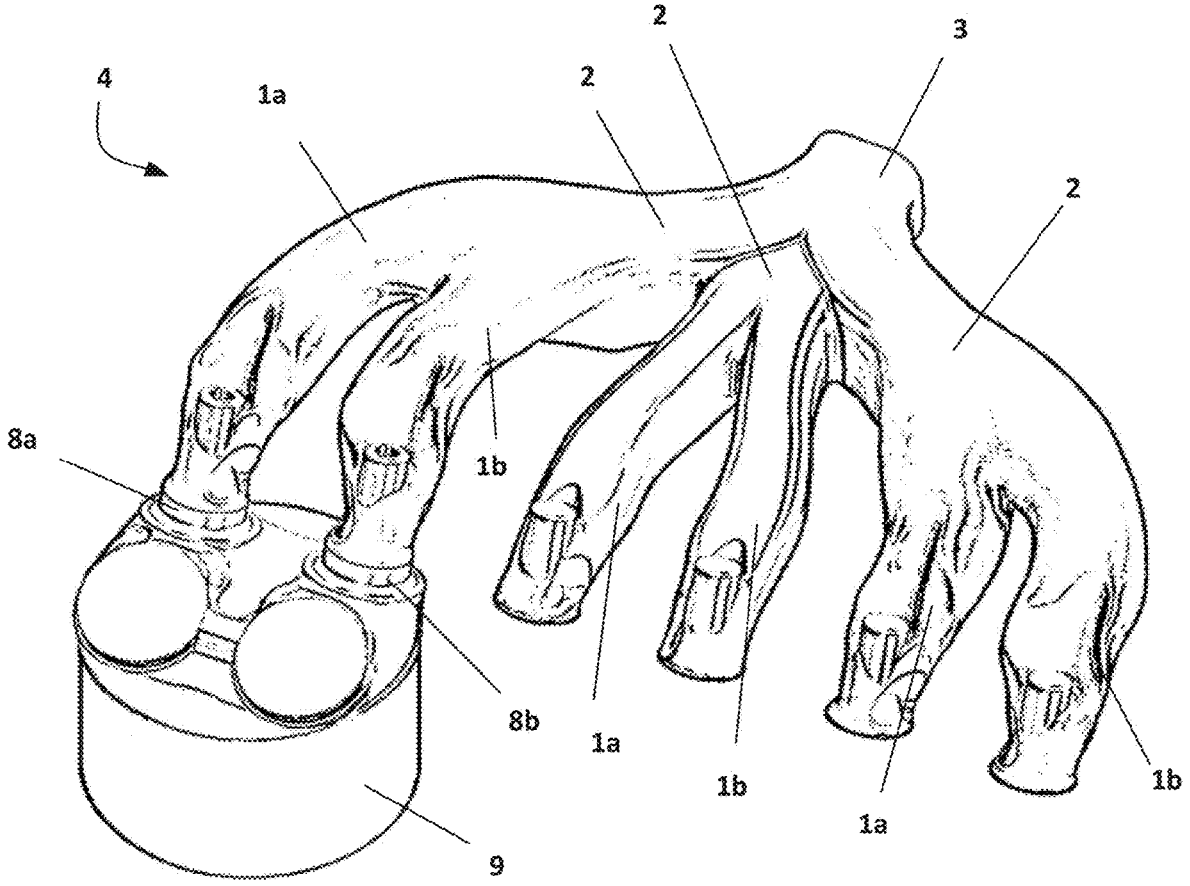
FIG. 1B shows diagrammatically, in a perspective view, the exhaust manifold integrated into the cylinder head of a first embodiment of the internal combustion engine, together with a fragment of a cylinder.

FIG. 1B shows diagrammatically, in a perspective view, the exhaust manifold 4 integrated into the cylinder head of an embodiment of the internal combustion engine, together with a fragment of a cylinder 9. This embodiment shows an exhaust manifold 4 of a three-cylinder in-line engine which has three cylinders 9, two outer cylinders and one inner cylinder. The manifold 4 is shown from above or the top.

Each of the three cylinders 9 is equipped with two outlet openings 8*a*, 8*b*, wherein each outlet opening 8*a*, 8*b* is adjoined by an exhaust line 1*a*, 1*b*. The exhaust lines 1*a*, 1*b* of each cylinder 9 merge to form a partial exhaust line 2 associated with the cylinder 9, wherein the partial exhaust lines 2 in turn merge subsequently, that is to say downstream, to form a common overall exhaust line 3. All the exhaust gas from the cylinders 9 passes through the overall exhaust line 3.

Starting from an outlet opening 8*a*, 8*b* of the cylinder 9, the adjoining exhaust line 1*a*, 1*b* changes its cross-section in the flow direction.

Figure 2A:
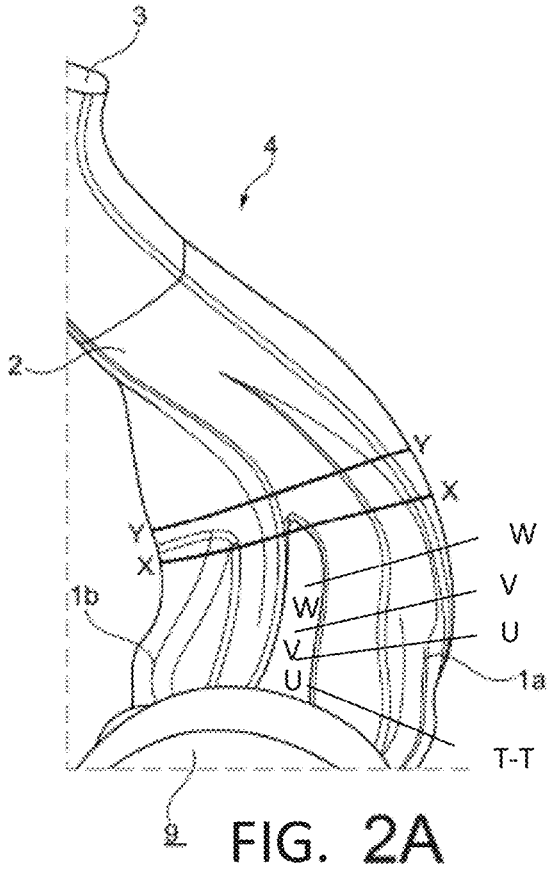
FIG. 2A shows a fragment of the exhaust manifold shown in FIG. 1B with a view onto the underside of the manifold.

FIG. 2A shows a fragment of the exhaust manifold 4 shown in FIG. 1B with a view onto the underside of the manifold 4. The cross-section 5*a*, 5*b* of each exhaust line 1*a*, 1*b* changes in the flow direction, wherein the cross-section 5*a*, 5*b* in places has an L-shaped outline such that the overall shape of the cross-section is L-shaped.

Figure 2B:
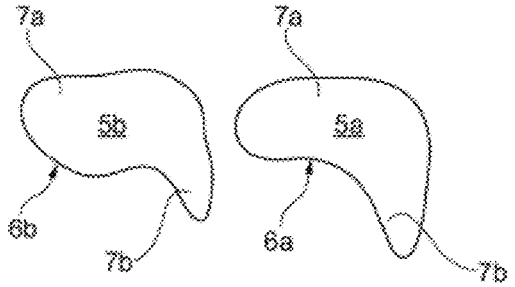
FIG. 2B shows the cross-section X-X marked in FIG. 2A.
Figure 2C:
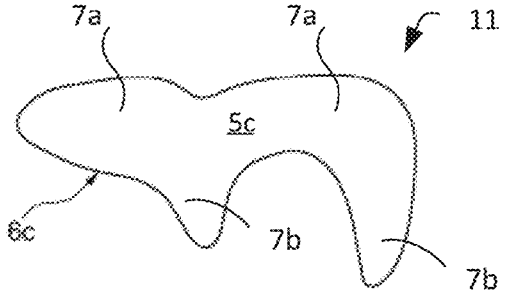
FIG. 2C shows the cross-section Y-Y marked in FIG. 2A.

Cross-sections X-X and Y-Y are marked in FIG. 2A, which are shown in FIGS. 2B and 2C. Both sections run inclined by an angle $\beta \approx 45°$ relative to the longitudinal axis of the cylinder 9. The longitudinal axis of the cylinder is shown as the z-axis in FIG. 6. An angle of inclination of an exhaust passage can be seen relative to his z-axis.

FIG. 2B shows the section X-X marked in FIG. 2A through the two separate exhaust lines 1*a*, 1*b*. The substantially L-shaped cross-sections 5*a*, 5*b* are each delimited by an associated edge 6*a*, 6*b* which runs in a curving fashion, so that the cross-sections 5*a*, 5*b* have rounded corners.

The depicted embodiment cross-section 5*a*, 5*b* has two limbs 7*a*, 7*b* which are connected together and form an angle $\alpha$. The depicted angle is greater than 90° but the angle will vary with the embodiment and location of the section on the exhaust passage.

Figure 6:
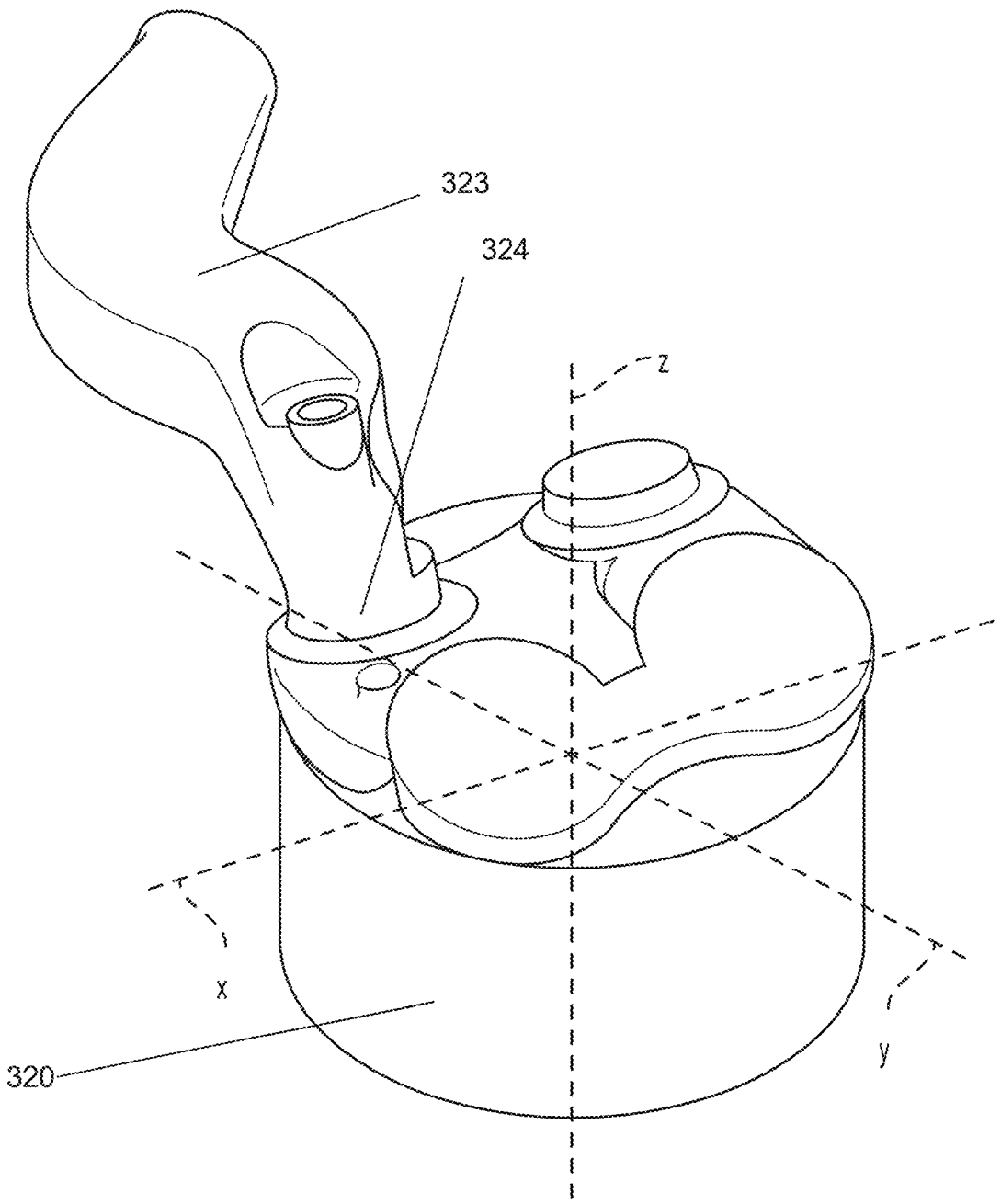
FIG. 6 is a view of a cylinder and exhaust passage.

An upper limb 7*a* of each cross-section 5*a*, 5*b* is arranged on the top of the exhaust manifold 4, i.e. on the side of the manifold 4 facing away from the cylinder 9 and forming part of the top side of the manifold 4 or toward the top face of a cylinder head. For example, FIG. 6 depicts a z-axis of a cylinder. The upper limb 7*a* is arranged on a side of the exhaust passage distal from the cylinder in a z-direction. The upper limb 7*a* may have a planar shape primarily extending in the x and y directions of the cylinder and have a thickness primarily in a z direction of the cylinder. The exhaust passage may also extend at an angle relative to the cylinder.

A side limb 7*b* of each cross-section 5*a*, 5*b* is arranged at an angle from the upper limb 7*a*. This angle can be used to determine the orientation of the side limb 7*b*. In some embodiments, the angle is approximately 90 degrees. In this instance, the side limb 7*b* will extend primarily in a z and y plane and have a thickness in the x direction. The side limb 7*b* may extend in a similar direction to a vertical side wall of a cylinder head or exhaust manifold 4.

Both the upper and side limbs 7 may taper towards their free ends. Also, the second side limb 7*b* may be narrower and shorter than the associated first upper limb 7*a*.

FIG. 2C shows the section Y-Y marked in FIG. 2A through partial exhaust lines 2 belonging to the cylinder. The substantially F-shaped cross-section 5*c* of the partial exhaust line 2 is delimited by an associated edge 6*c* which runs in curving fashion, so that the cross-section 5*c* has rounded corners.

FIG. 2C shows that passages 1*a* and 1*b* with substantially L-shape cross-sections 5*a* and 5*b* may merge forming a merged passage 11. The merged passage 11 may include attributes of the cross-sections 5*a* and 5*b*. For example, the merged passage 11 may include four limbs forming two angles. These four limbs and two angle correspond to the limbs 7*a* and 7*b* of FIG. 2B. The angles will be discussed in greater detail in regards to FIG. 3. The cross-section of the merged passaged 11 may have many shapes. In an embodiment of a cross-section with four limbs and two angles as depicted, the two angles may vary, the length of each limbs may vary, the taper of each of the limbs may vary or all of characteristics may vary simultaneously. Merged passages 11 may also change shape such that four limbs are no longer present. In one embodiment the side limbs 7*b* may shorten until they are no longer present, leaving only two limbs remaining. Many other shapes of the cross-section consistent with this application will be appreciated by one of ordinary skill in the art.

The cross-section of the merged passage 11 may continue to change as the merged passage 11 extends. The merged passage 11 may have a cross-section that becomes more uniform as it extends. A uniform cross-section may be substantially circular, elliptical, square or rectangular. This uniform shape may occur by the shortening of the side limbs 7*b* and upper limbs 7*a*.

Figure 3:
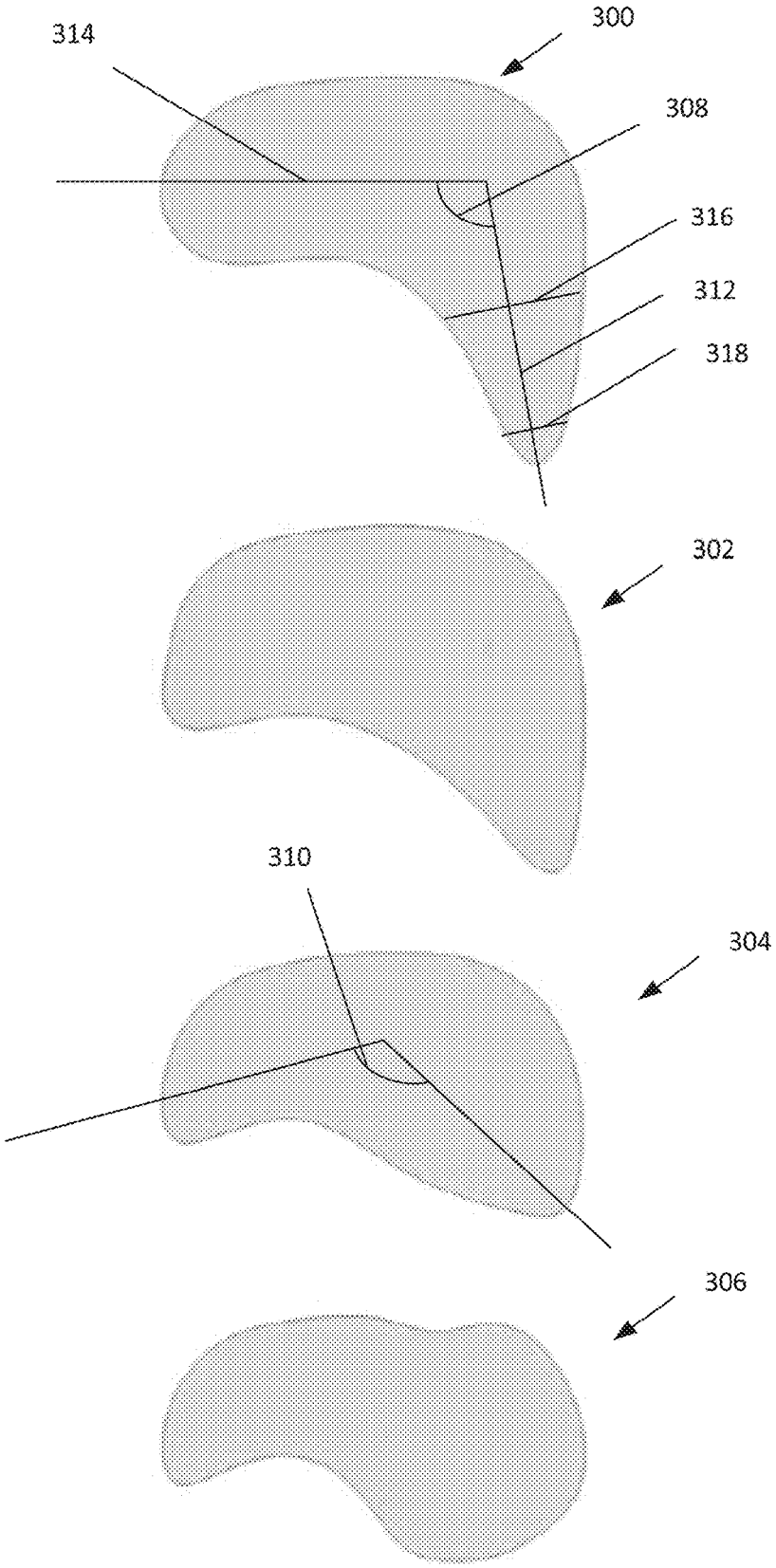
FIG. 3 shows further embodiments of exhaust passage cross-sections.

FIG. 3 depicts further cross-sections of partial exhaust passage 1*a*. Cross-section 300 is depicted in FIG. 2A as W-W. Cross-section 300 depicts an angle 308 between limbs 312 and 314. The angle depicted in FIG. 3 is greater than 90 degrees but this angle may vary as the passage extends and in other embodiments. As shown in cross-section 304 with angle 310, the angle can be greater than depicted by angle 308. This angle can also be less than 90 degrees or approximately 90 degrees.

Cross-section 300 also depicts the shape of elements of the cross-section. The taper of limb 312 can be seen in cross-section 300. A distal width 318 of limb 312 is less than a more central width 316. This depiction shows that limbs may taper as they extend. However, limbs may have other shapes as well. Limb 314 shows a limb with edges that extend approximately parallel while cross-section 306 show a limb which widens as it extends distally.

Further cross-sections of exhaust passage 1*a* are depicted in FIG. 3. Cross-section 302 is depicted in FIG. 2A as V-V. Cross-section 304 is depicted in FIG. 2A as U-U. Cross-section 306 is depicted in FIG. 2A as T-T. The cross-sections 300, 302, 304, and 306 depict how the shape of exhaust passage 1*a* changes as it extends in a flow direction of the exhaust. Initially, the cross-section is non-uniform and round, as depicted in cross-section 306. As the exhaust passage extends, the cross-section becomes more defined and the angle between the limbs decreases as shown in cross-section 300. Then, the cross-section may merge with another passage as shown by merged passage 11, depicted in FIG. 2C. The merged passage 11 may then continue to change shape and merge with other passages before exiting the cylinder head.

Figure 4:
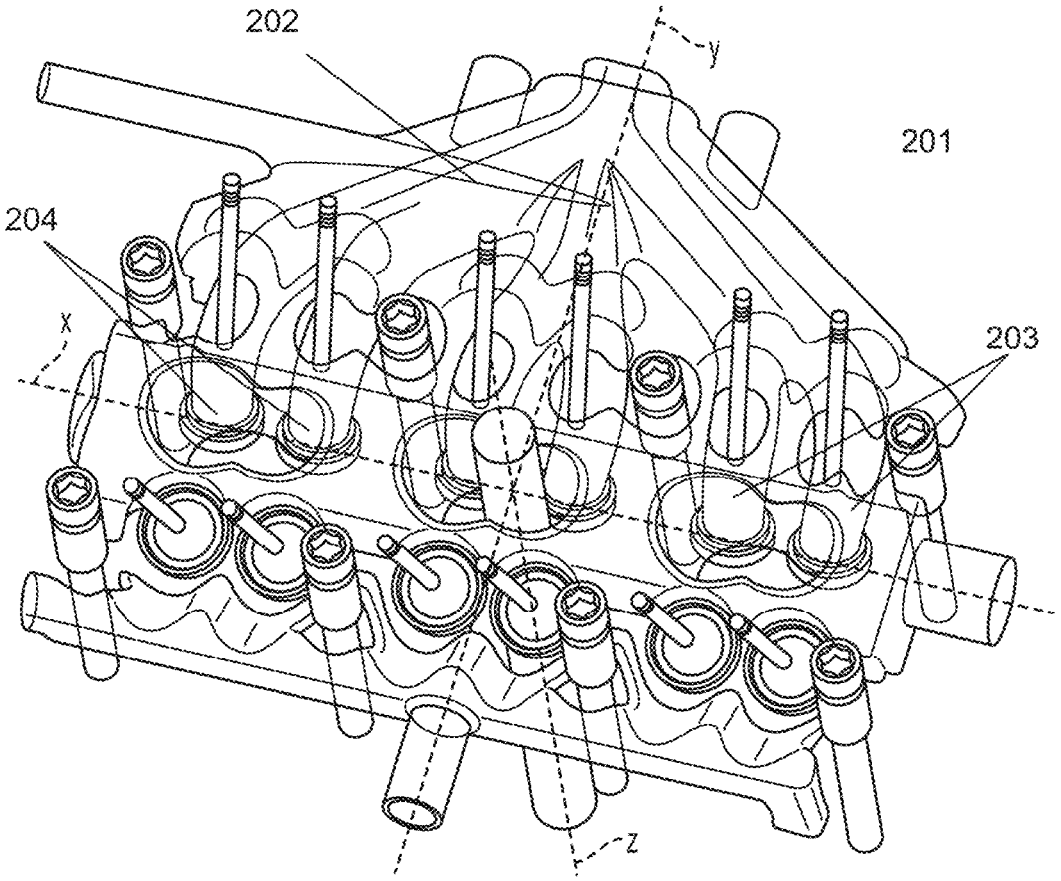
FIG. 4 is a top down view through a cylinder head of an engine with integrated exhaust manifold.

FIG. 4 depicts a top down view of an engine. FIG. 4 shows an engine 201 with integrated exhaust manifold 202. FIG. 1 also includes exhaust passages 203 and outlet openings 204. Exhaust gas exits the cylinder through the outlet openings 204. FIG. 4 also depicts the axes that will be used for reference in the present application. The z-axis is oriented longitudinally with the cylinder. The x-axis is oriented perpendicular to the z-axis and extends through the cylinders in multi-cylinder engines. The y-axis is perpendicular to both the x-axis and z-axis and extends away from the cylinder bank in multi-cylinder engines.

Embodiments feature exhaust lines of an engine that merge within the cylinder head, so as to form an integrated exhaust manifold. If the exhaust lines merge within the cylinder head, so as to form an integrated exhaust manifold, the cross-sections according to the application are inevitably arranged within a cylinder head. Other embodiments may also feature conventional exhaust manifolds with exhaust line cross-sections according to the application outside of the cylinder head. These embodiments may feature at least two exhaust lines merging to form an overall exhaust line outside the at least one cylinder head.

Figure 5:
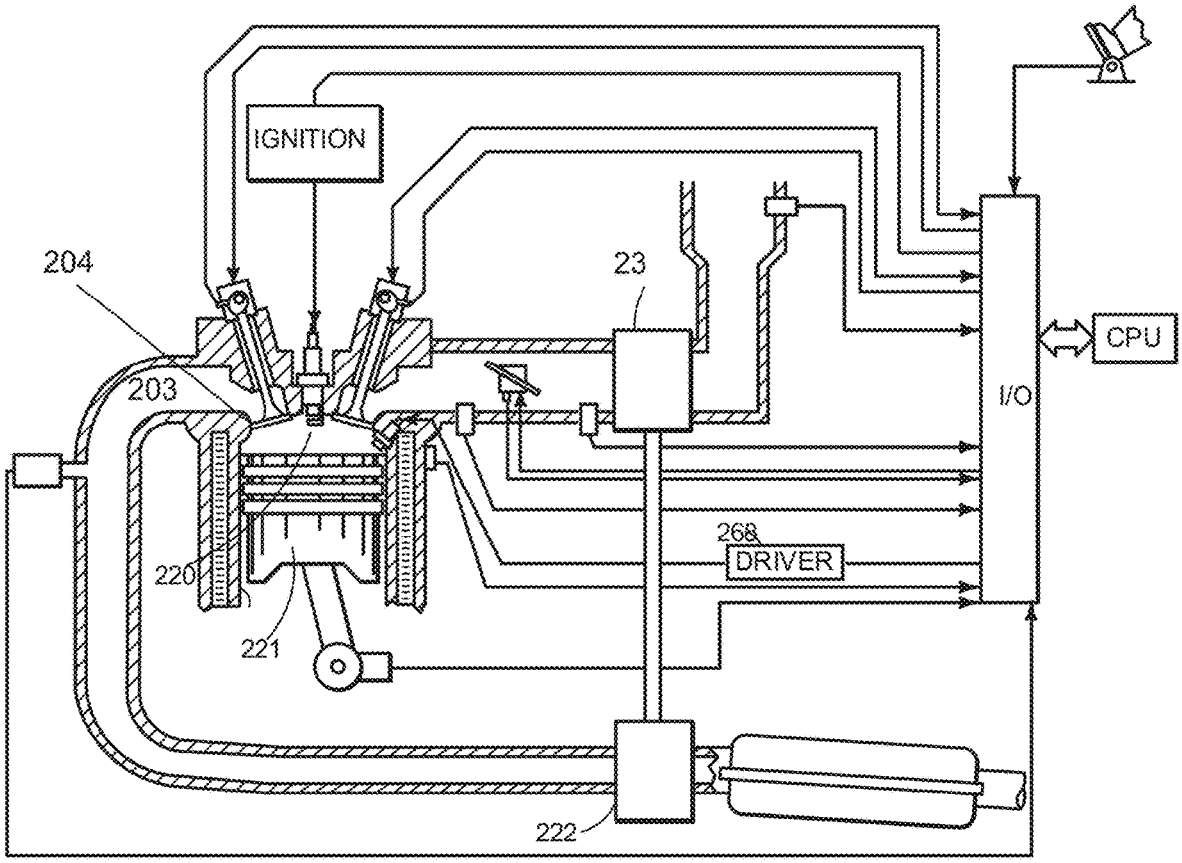
FIG. 5 is a schematic view of an engine featuring a turbocharger.

FIG. 5 is a schematic view of an engine system. FIG. 5 depicts a cylinder 220 with a piston 221. Exhaust gas exits the cylinder 220 through outlet openings 204 and travels through exhaust passages 203. The exhaust passage 203 is connected to a turbine 222. The turbine 222 is connected to compressor 223 which charges air.

FIG. 6 shows cylinder 320 and exhaust passage 323. Exhaust gas travels through the outlet opening 324 into exhaust passage 323. The axis system described in FIG. 4 is also shown in FIG. 6. FIG. 6 shows an exhaust passage that changes direction relative to all three axes. FIG. 6 depicts a configuration wherein the gas traveling through the passage would initially be traveling in a primarily z direction before bending to travel in a primarily y direction. A further bend would direct the gas into a direction defined by both x and y. This configuration is only one embodiment of the application. Other embodiments could include shapes with shorter traveling distances, less z direction travel, smoother curves, and many other configurations.

The invention claimed is:

1. An internal combustion engine having at least one cylinder head comprising at least one cylinder, in which each cylinder has at least one inlet opening, each inlet opening being adjoined by an intake line for the supply of air via an intake system, each cylinder has at least one outlet opening, each outlet opening being adjoined by an exhaust line for the discharge of exhaust gas via an exhaust-gas discharge system, and at least one exhaust line has a cross-section which changes in a flow direction, wherein the cross-section has an L-shaped outline, wherein the cross-section is arranged within the at least one cylinder head.

2. The internal combustion engine as claimed in claim 1, wherein the cross-section has at least one rounded corner.

3. The internal combustion engine as claimed in claim 1, wherein an edge which delimits the cross-section runs in curving fashion.

4. The internal combustion engine as claimed in claim 1, having at least two exhaust lines, wherein the at least two exhaust lines merge to form one exhaust line within the at least one cylinder head.

5. The internal combustion engine as claimed in claim 1, wherein the cross-section has two limbs which are connected together and form an angle $\alpha$ and the angle $\alpha$ meets the following criterion at point in the cross-section: $\alpha \geq 90°$.

6. The internal combustion engine as claimed in claim 5, wherein the angle $\alpha$ meets the following criterion: $\alpha \leq 90°$ at a second point in the cross-section.

7. A method for producing a cylinder head of an internal combustion engine as claimed in claim 1, wherein the cylinder head is cast.

8. An internal combustion engine having at least one cylinder head comprising at least one cylinder, in which each cylinder has at least one inlet opening, each inlet opening being adjoined by an intake line for the supply of air via an intake system, each cylinder has at least one outlet opening, each outlet opening being adjoined by an exhaust line for the discharge of exhaust gas via an exhaust-gas discharge system, and at least one exhaust line has a cross-section which changes in a flow direction, wherein the cross-section has an L-shaped outline, wherein an edge which delimits the cross-section runs in undulating fashion.

9. An internal combustion engine having at least one cylinder head comprising at least two cylinders, in which each cylinder has at least one inlet opening, each inlet opening being adjoined by an intake line for the supply of air via an intake system, each cylinder has at least two outlet openings, each outlet opening being adjoined by an exhaust line for the discharge of exhaust gas via an exhaust-gas discharge system, and at least one exhaust line has a cross-section which changes in a flow direction, wherein the cross-section has an L-shaped outline, wherein the at least two exhaust lines of each cylinder first merge into a partial exhaust line before the partial exhaust lines merge into at least one overall exhaust line, and the merging into at least one overall exhaust line occurs within the at least one cylinder head.

10. The internal combustion engine as claimed in claim 9, in which the cross-section has two limbs which are connected together and form an angle $\alpha$, wherein a first upper limb of the cross-section is arranged on a side of the exhaust passage opposite the at least one cylinder.

11. The internal combustion engine as claimed in claim 10, wherein a second side limb of the cross-section is arranged at angle $\alpha$ from the first upper limb and extends toward the cylinder.

12. The internal combustion engine as claimed in claim 11, wherein the second side limb tapers towards its free end.

13. The internal combustion engine as claimed in claim 12, wherein the second side limb is narrower and/or shorter than the first upper limb.

* * * * *